US008857844B1

(12) United States Patent
Weber et al.

(10) Patent No.: US 8,857,844 B1
(45) Date of Patent: Oct. 14, 2014

(54) TRANSPORT DEVICE TO TRANSPORT USER AND LOWER AND RAISE USER TO POOL DECK FOR POOL ACCESS

(71) Applicants: Kenneth Carl Weber, Ann Arbor, MI (US); James A. Fox, Saline, MI (US); Michael Shinkevich, Whitmore Lake, MI (US)

(72) Inventors: Kenneth Carl Weber, Ann Arbor, MI (US); James A. Fox, Saline, MI (US); Michael Shinkevich, Whitmore Lake, MI (US)

( * ) Notice: Subject to any disclaimer, the term of this patent is extended or adjusted under 35 U.S.C. 154(b) by 0 days.

(21) Appl. No.: 13/573,948

(22) Filed: Oct. 16, 2012

(51) Int. Cl.
*A61G 5/10* (2006.01)

(52) U.S. Cl.
CPC ..... *A61G 5/1059* (2013.01)
USPC ..... 280/304.1; 280/250.1; 297/344.14; 297/330; 297/344.12; 297/344.13; 4/560.1; 4/561.1; 4/564.1; 4/604

(58) Field of Classification Search
USPC ..... 280/304.1, 250.1; 297/344.14, 330, 297/344.12, 344.13; 4/560.1, 561.1, 564.1, 4/604
See application file for complete search history.

(56) References Cited

U.S. PATENT DOCUMENTS

| | | | | |
|---|---|---|---|---|
| 3,937,519 | A | 2/1976 | Schoolden | |
| 4,432,425 | A | 2/1984 | Nitzberg | |
| 4,595,237 | A | 6/1986 | Nelsen | |
| 5,353,446 | A * | 10/1994 | Baranowski | 4/496 |
| 5,382,130 | A | 1/1995 | Kempf | |
| 5,685,030 | A * | 11/1997 | Baranowski | 4/496 |
| 6,070,278 | A | 6/2000 | Smith | |
| 6,471,454 | B1 * | 10/2002 | Koller | 410/7 |
| 7,273,255 | B2 * | 9/2007 | Nylander et al. | 297/338 |
| 7,506,385 | B2 * | 3/2009 | Werschmidt | 4/561.1 |
| 7,547,031 | B2 | 6/2009 | Moran et al. | |
| 8,398,108 | B2 * | 3/2013 | Andrews | 280/304.1 |
| 2005/0166312 | A1 * | 8/2005 | Cancian | 4/604 |
| 2007/0227787 | A1 | 10/2007 | Kuramoto | |
| 2008/0042404 | A1 * | 2/2008 | Mariani et al. | 280/657 |
| 2010/0108418 | A1 | 5/2010 | Kuramoto | |
| 2011/0248471 | A1 * | 10/2011 | Springer | 280/304.1 |

* cited by examiner

*Primary Examiner* — Joseph M Rocca
*Assistant Examiner* — Marlon Arce
(74) *Attorney, Agent, or Firm* — Barbara M. Burns

(57) ABSTRACT

A transport device for a user of a wheel chair to access a pool or a lower surface that the wheel chair rests upon, the device employing a frame, a lift mechanism, gearing to operate the lift mechanism, drive wheels, stabilizing wheels, locking devices, clamping device, handle grips and holding pads. The transport device is entered by a wheel chair user from a site away from a pool. The user moves the transport device near to an edge of a pool. The lock device is deployed and the lift mechanism is operable by the user of the transport device. The lift mechanism raises and lowers the user to the surface of the pool edge. A rest pad can be deployed under the seat portion. The device to hold the transport device at or near the edge of the pool or at a surface that the wheel chair rests upon has a pivotable clamp and/or stop/hold pads under the handle grips.

4 Claims, 2 Drawing Sheets

TRANSPORT DEVICE TO TRANSPORT USER AND LOWER AND RAISE USER TO POOL DECK FOR POOL ACCESS

BACKGROUND OF THE INVENTION

The field of the invention pertains to wheel chairs, and, in particular, to the use of a wheel chair to access a pool.

Access to a pool has involved either a ramp or a device that swings out over the pool and lowers a disabled person into the water of a pool.

A problem is that the pool surround surface may be limited in size and not have space for a ramp. Another problem is that a device that swings out over the pool is large and unwieldy.

Another problem is that should space be available to construct a ramp, this is a substantial reconstruction cost to the owner of the pool. Particularly at a hotel, the reconstruction costs may be more than an owner can reasonably expend to keep a pool available. A swing device to move a user of a wheelchair over a pool and to lower and raise the person can also be quite expensive.

A need existed for a device to allow a wheel chair user to access a pool without requiring extensive reconstruction of the facility around the pool.

SUMMARY OF THE INVENTION

The invention is a transport device to allow a user of a wheel chair to access a pool. The transport device can comprise a frame, a lift mechanism, gearing to operate the lift mechanism, drive wheels, stabilizing wheels, locking devices, clamping device, handle grips and holding pads. The transport device can allow a user of a wheel chair to access a lower surface, such as the surface the wheel chair rests upon.

The transport device of the invention can be entered by a wheel chair user from his/her own wheel chair at a location away from the pool edge. The user of the wheel chair transfers to the transport device and then the user moves the transport device of the invention near to the edge of the pool.

The transport device has a portion that can be raised and lowered by the user. The transport device has stabilizing wheels at the front bottom part of the device and larger drive wheels at the sides of the device.

At poolside, a user of the transport device engages a locking device to the drive wheels that can stabilize the transport device to keep the transport device from moving.

A user of the transport device operates a manual crank handle to raise and lower the seat of the transport device with minimum force required by the user. The crank operates a gear set to move the portion that can be raised and lowered by the user. The portion that can be raised and lowered travels in a vertical direction. A seat for the user can be affixed to the portion that can be raised and lowered.

When the seat portion of the transport device is lowered, a rest pad under the seat can engage with the pool surround surface. In the lowered position, the rest pad frictionally engages with the pool surround surface to keep the transport device from moving. From the lowered seat, the user can access the edge of the pool and enter the pool.

A clamp device can extend from the lower front of the transport device. The clamp device can be operated by the user to lock the transport device to the edge of the pool for further stabilizing and to prevent the transport device from moving away from the edge of the pool.

The clamp device can pivot and clamp to the pool edge and/or the underside of a protrusion from the pool edge to aid stabilizing the transport device. The clamp device can overhang the edge of the pool. The clamp device comprises a cam lock mechanism to lock the transport device to the rounded underside of the pool edge to aid entering and exiting the transport device at the pool edge. If no overhang exists on the side of the pool, the clamp can brace against the vertical wall of the pool to keep the transport device from moving away from the edge of the pool. The clamp device and grab handles can be attached to the lift mechanism, and thus can be raised and lowered by the lift mechanism of the transport device.

The user can remove himself/herself from a pool by grasping grab handles extending from near the front bottom of the transport device and pulling himself/herself up onto the pool edge to access the transport device.

The grab handle can employ a stop pad or a hold pad to keep the transport device from moving when a user pulls himself/herself up out of the pool. The stop pad or hold pad under the handle grip can have a wedge shape to facilitate the holding/stopping of the transport device.

Thusly, can a user of the transport device enter and exit a pool.

The environment wherein the transport device operates can be moist due to humidity from a pool. The drive wheels of the transport device can be comprised from standard wheelchair type wheels, while the lift frame and mechanism of the transport device can be comprised from stainless steel. The seat of the transport device that is raised and lowered can be comprised from a hard water proof plastic material. The gear of the transport device can employ a helical gear design and the gear ratio can require less than four pounds on the handle of the gear to raise the seat with a person on, or in, it. The gear lift mechanism of the transport device has a ratchet, or lock, that would prevent the mechanism from 'spinning' when lifting or lowering the seat.

The clamp of the transport device for use at the side of the pool can be fabricated from stainless steel. The grab handles can be comprised from stainless steel and have a rubber or plastic handle grip. The stop or hold pads under the seat and under the handle grips can be comprised from a component having a friction vector suitable for gripping, thusly limiting the device from sliding.

For a more complete understanding of the present invention, reference is made to the following detailed description when read with in conjunction with the accompanying drawings wherein like reference characters refer to like elements throughout the several views, in which:

DESCRIPTION OF THE PREFERRED EMBODIMENT

Illustrated in FIGS. 1, 2, 3, 4, and 5 new transport device 10 is shown.

Figure 1:
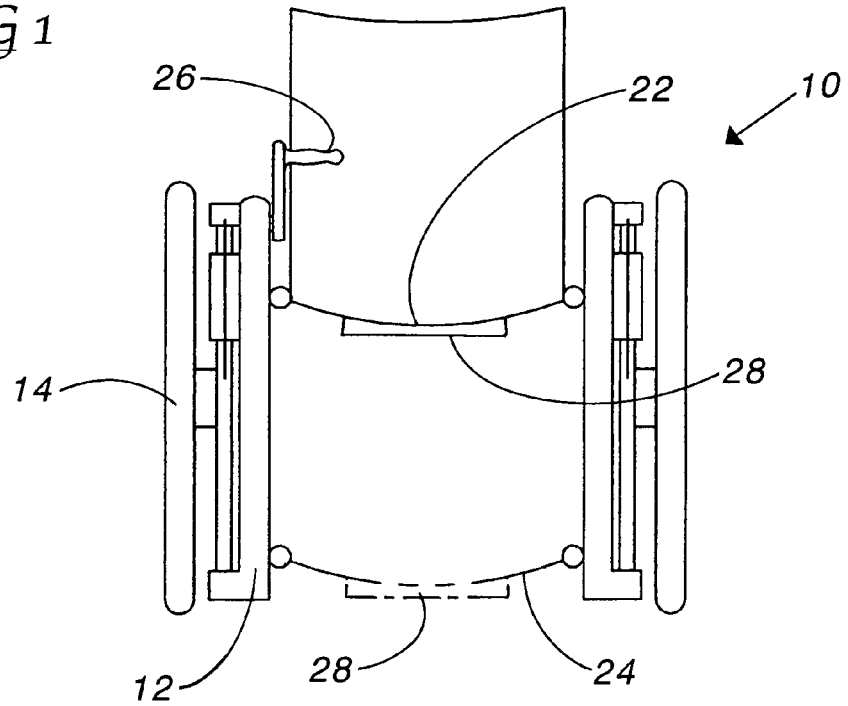
FIG. 1 illustrates a front view of the new transport device for accessing a pool.
Figure 2:
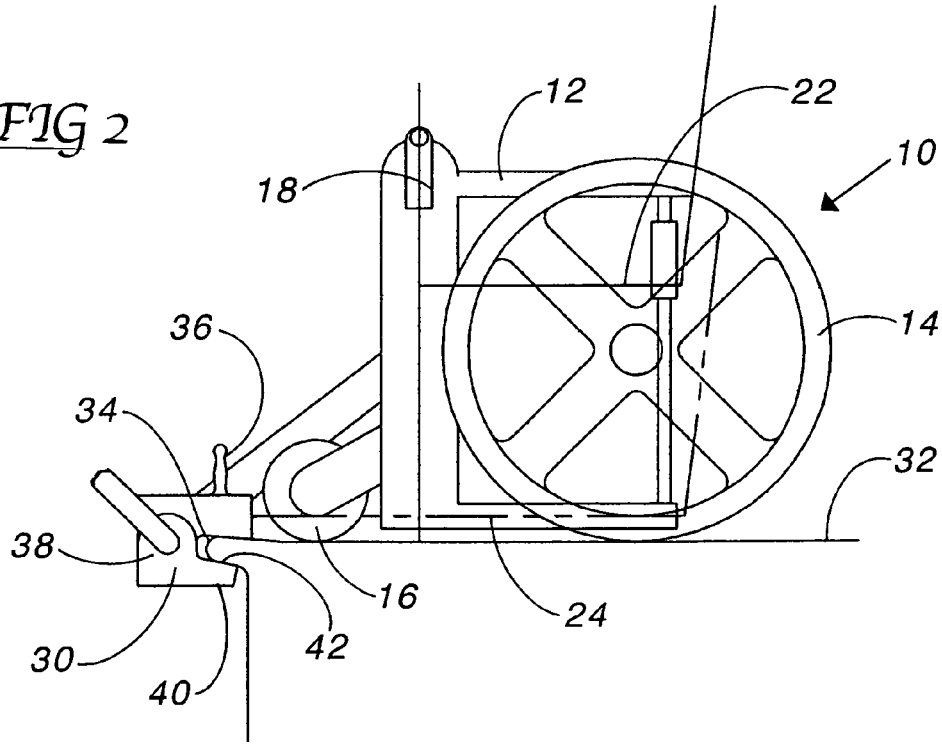
FIG. 2 illustrates a side view of the new transport device with a clamp device extending from the transport device.

Transport device 10 having drive wheels 14 and stabilizing wheels 16 rotatably attached to frame 12 (FIGS. 1 and 2). Lift mechanism 18 of frame 12 raises and lowers seat portion 20 between raised position 22 and lowered position 24. Crank handle 26 operates lift mechanism 18. Pad 28 attaches to the bottom side of seat portion 20.

Clamp device 30 is shown in FIG. 2. Clamp device 30 is in the lowered position 24 near to pool surround surface 32 and pool edge 34. Grab handle 36 is shown as will be further explained.

Pivot portion 38 of clamp device 30 is shown in deployed position 40 clamped under protruding edge 42 of pool edge 34.

Figure 3:
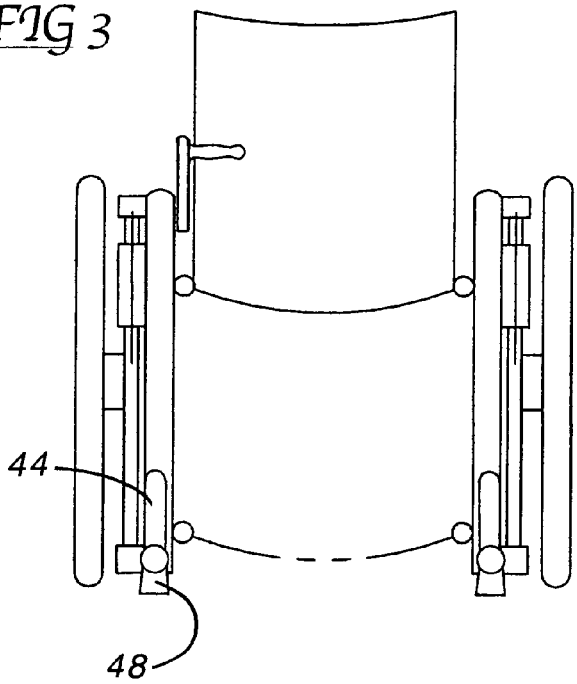
FIG. 3 illustrates a front view of the new transport device with a grab handle extending from the front of lower portion of the transport device.
Figure 4:
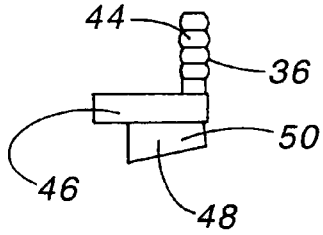
FIG. 4 illustrates a left side view of a grab handle of the transport device.
Figure 5:
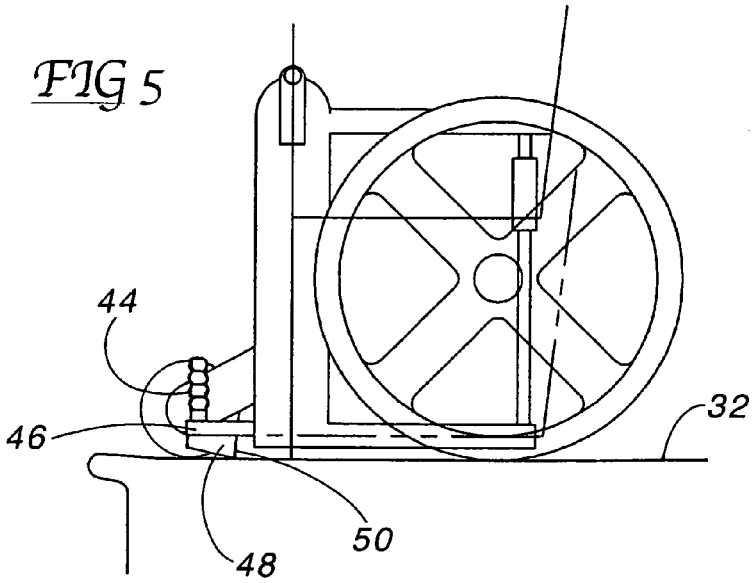
FIG. 5 illustrates a right side view of the new transport device with a grab handle extending from the front of lower portion of the transport device.

Now turning to FIGS. 3, 4, and 5, thereshown in more detail is grab handle 36. Grab handle 36 is shown with handle portion 44, extended portion 46 and pad 48. Pad 48 has wedge configuration 50.

The invention claimed is:

1. A transport device for a user, operable by the user himself/herself to access a pool, the pool having an edge, the transport device comprising:

a frame having drive wheels and stabilizing wheels attached to the frame;

a lift mechanism adjustably attached to the frame for raising and lowering a seat portion;

gearing to operate the lift mechanism; and a device to hold the transport device at one of near and at the edge of a pool, wherein the device for holding the transport device at one of near and at the edge of the pool comprises a pivotable section enagageable with the edge of the pool, Wherein the pivotable section being connected to the lift mechanism for raising and lowering a seat portion;

a holding pad being positioned under the seat portion, and whereby a user of the transport device accesses and exist the pool by himself/herself without requiring assistance by a second person.

2. A transport device for a user to access a pool, the pool having an edge, the transport device comprising:

a frame having drive wheels and stabilizing wheels attached to the frame;

a lift mechanism adjustably attached to the frame for raising and lowering a seat portion;

a holding pad being positioned under the seat portion;

gearing to operate the lift mechanism; and a device to hold the transport device at one of near and at the edge of a pool, wherein the device for holding the transport device at one of near and at the edge of the pool comprises a pivotable section enagageable with the edge of the pool, wherein the pivotable section being connected to the lift mechanism for raising and lowering a seat portion.

3. The transport device for a user to access a pool according to claim 2, further comprising a handle grip having a holding pad being positioned under the handle grip.

4. The transport device for a user to access a pool according to claim 3, wherein the holding pad being positioned under the handle grip having a wedge shape.

* * * * *